US006621016B2

(12) United States Patent
Ohba et al.

(10) Patent No.: US 6,621,016 B2
(45) Date of Patent: Sep. 16, 2003

(54) COMPLEX OPERATION INPUT DEVICE

(75) Inventors: Katsuichi Ohba, Miyagi-ken (JP); Sachiko Homma, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/136,790

(22) Filed: Apr. 30, 2002

(65) Prior Publication Data

US 2002/0166754 A1 Nov. 14, 2002

(30) Foreign Application Priority Data

May 14, 2001 (JP) ..... 2001-143259

(51) Int. Cl.[7] ..... H01H 9/00
(52) U.S. Cl. ..... 200/4; 200/11 R; 200/5 R
(58) Field of Search ..... 200/4, 5 R, 11 R, 200/11 D, 11 DA, 18, 336

(56) References Cited

U.S. PATENT DOCUMENTS 4,659,881 A * 4/1987 Dowe ..... 200/5 R
5,369,230 A * 11/1994 Misawa ..... 200/4
5,744,765 A * 4/1998 Yamamoto ..... 200/5 R
5,821,480 A * 10/1998 Machida ..... 200/4
6,067,424 A * 5/2000 Shono ..... 200/336
6,339,200 B1 * 1/2002 Shi et al. ..... 200/305
6,492,602 B2 * 12/2002 Asai et al. ..... 200/1 B

FOREIGN PATENT DOCUMENTS

JP 10-177826 6/1998

* cited by examiner

*Primary Examiner*—Elvin Enad
*Assistant Examiner*—M. Fishman
(74) *Attorney, Agent, or Firm*—Beyer Weaver & Thomas, LLP

(57) ABSTRACT

In a complex operation input device according to the invention, a rotary electrical part manipulated with an operating member and a double-action push switch unit are arranged in a layered state in a direction of a rotation axis of the rotary electrical part. As a result, the device can be reduced in lateral size, and therefore it is made possible to provide a complex operation input device which can be used with a portable digital camera particularly suitably.

16 Claims, 7 Drawing Sheets

COMPLEX OPERATION INPUT DEVICE

BACKGROUND OF THE INVENTION

1. Field of the Invention

The present invention relates to a complex operation input device that can be suitably used with a digital camera or the like.

2. Description of the Prior Art

To describe the configuration of a complex operation input device according to the prior art with reference to FIG. 10 and FIG. 11, a fixed member 52 is fitted above a housing 51, which is a molded synthetic resin item.

An insulating substrate 53 is fitted to the housing 51 so as to cover a receptacle 51*a* provided in the housing 51, and over this insulating substrate 53 is mounted a first flexible insulating substrate 54 having a plurality of fixed contacts (not shown).

A movable contact 55 consisting of a leaf spring, in a state of opposing fixed contacts provided on the first flexible insulating substrate 54, is mounted on the first flexible insulating substrate 54. As the upper part of the movable contact 55 is pressed and reversed, the movable contact 55 comes into contact with one of the fixed contacts. These fixed contacts and movable contact 55 constitute a first push switch part S3.

A second flexible insulating substrate 56 provided with a fixed contact (not shown) is arranged so as to cover the upper part of the movable contact 55, and the fixed contact provided on this second flexible insulating substrate 56 is connected by a communicating means (not shown) to the fixed contacts provided on the first flexible insulating substrate 54.

A holding member 57, which is a molded synthetic resin item, has a plate 57*a* and a cylindrical shaft 57*b* provided over this plate 57*a*, and this holding member 57, in a state in which its plate 57*a* is accommodated in the receptacle 51*a*, is rotatably held by pressing the shaft 57*b* through the fixed member 52.

A rubber contact 58 provided with a contact point is fitted within the shaft 57*b* so as to oppose the fixed contact provided on the second flexible insulating substrate 56.

When the upper part of the rubber contact 58 is suppressed, the rubber contact 58 is bent to come into contact with the fixed contact provided on the second flexible insulating substrate 56. These fixed contact and rubber contact 58 constitute a second push switch part S4.

As a result, the first and second push switch parts S3 and S4 constitute a two-stage suppressive switching section P2, and the first and second push switch parts S3 and S4 constituting this two-stage suppressive switching section P2 are arranged in a layered state in the direction of the rotation axis G2 of the holding member 57.

In the two-stage suppressive switching section P2, first the rubber contact 58 is pressed to operate the second push switch part S4, and its continued pressing causes the movable contact 55 to be suppressed to operate the first push switch part S3.

A slider 59 consisting of a metal plate is fitted to the plate 57*a* in a position outer than the two-stage switching section P2 in the radial direction, and this slider 59 comes into sliding contact with the fixed contact provided on the first flexible insulating substrate 54. These fixed contact and slider 59 constitute a rotary electrical part D2.

This rotary electrical part D2 is arranged in a radial direction orthogonal to the rotation axis G2 of the two-stage suppressive switching section P2.

A lever 60, which is a molded synthetic resin item, has a holder 60*a* and an arm 60*b* extending in one direction from this holder 60*a*. This lever 60, in a state of being linked so as to rotate the holding member 57, is arranged over the fixed member 52.

A key top 61 arranged to be able to suppress the rubber contact 58, in a state in which it is prevented from coming off by the holder 60*a* of the lever 60, is fitted to be shiftable in the direction of the rotation axis G2.

A button 63, which is a molded synthetic resin item elastically pressed by a coil spring 62, is fitted to be vertically movable in a state in which it is prevented from coming off by the arm 60*b* of the lever 60. This button 63 is provided with a projection 63*a,* which can be engaged with and disengaged from the fixed member 52. When the button 63 is suppressed against the coil spring 62, the projection 63*a* can come off a hole 52*a* of the fixed member 52 to enable the lever 60 to rotate.

A spring 64 fixed to the rotatable holding member 57 can be engaged with and disengaged from the insulating substrate 53 to form a detent mechanism, so that, when the holding member 57 rotates, the spring 64 engages with or disengages from the insulating substrate 53 to give a sense of click to the rotary action of the holding member 57 and the lever 60.

To describe the operation of the conventional complex operation input device having such a configuration, first, when the key top 61 is suppressed in the direction of the rotation axis G2, the rubber contact 58 is pressed, and the second push switch part S4 is manipulated. When the key top 61 is further suppressed, the rubber contact 58 suppresses the movable contact 55 via the second flexible insulating substrate 56, and the first push switch part S3 is manipulated.

Then, when released from suppression by the key top 61, the movable contact 55 and the rubber contact 58 automatically return to their respective original states by their own elasticity, and the key top 61 returns to its own original state with the return of the rubber contact 58.

Next, when the button 63 is suppressed against the coil spring 62, the projection 63*a* is disengaged from the fixed member 52 to enable the lever 60 to turn, and if in this state the lever 60 is turned with the arm 60*b*, the holding member 57 will rotate to turn the slider 59, which comes into sliding contact with the fixed contact on the first flexible insulating substrate 54 to cause the rotary electrical part D2 to be operated.

Then, the spring 64 engages with or disengages from the insulating substrate 53 to cause the lever 60 to turn with a sense of click.

Or if the lever 60 is released from rotation, the lever 60 and the holding member 57 will be stopped by the detent mechanism where they have turned by a prescribed angle and, if in this position the button 63 is released from suppression, the button 63 will be pushed back by the coil spring 62 to enter into a state in which the fixed member 52 is engaged with the hole 52*a*.

Such manipulations cause the complex operation input device to be operated.

The complex operation input device according to the prior art, in which the two-stage suppressive switching section P2 and the rotary electrical part D2 are arranged in the radial direction orthogonal to the direction of the rotation axis G2, has a large dimension in the lateral direction, and accordingly involves a problem of allowing no size reduction in the radial direction.

Especially, there is a problem that the device is unsuitable for portable items, such as a digital camera.

There is another problem that, on account of the use of the mutually separate first and second flexible insulating substrates 54 and 56, not only is an extra task of electrically connecting them needed but also their incorporation is troublesome, resulting in poor productivity.

Still another problem is that, as the second flexible insulating substrate 56 provided with the fixed contact for the second push switch part S4 is mounted over the movable contact 55 of the first push switch part S3 and, moreover, the movable contact 55 is deformed in a state in which the rubber contact 58 is in contact with the fixed contact, the contact of the second push switch part S4 is destabilized.

SUMMARY OF THE INVENTION

Therefore, an object of the present invention is to provide a complex operation input device which permits a size reduction in the lateral direction, provides high productivity and stabilizes the contact of the double-action push switch unit.

A first means to solve the problems noted above has a configuration provided with an operating member, a rotary electrical part manipulated with the operating member and a double-action push switch unit manipulated with the operating member, wherein the rotary electrical part and the double-action push switch unit are arranged in a layered state in a direction of a rotation axis of the rotary electrical part.

A second means to solve the problems noted above has a configuration wherein the operating member comprises a rotatable knob and a key top shiftable in the direction of the rotation axis, the rotary electrical part is operated by rotation of the knob and the double-action push switch unit is operated,by shifting of the key top.

A third means to solve the problems noted above has a configuration wherein the knob is annularly shaped and arranged so as to surround an outer circumference of the key top.

A fourth means to solve the problems noted above has a configuration wherein the double-action push switch unit comprises two, first and second, push switch parts differing from each other in operating force, a carrier member is provided to support the double-action push switch unit, the carrier member has a plate, and over the plate the first and second push switch parts are arranged in a layered state in the direction of the rotation axis.

A fifth means to solve the problems noted above has a configuration wherein the first and second push switch parts click by operating forces differing from each other.

A sixth means to solve the problems noted above has a configuration further provided with a driver arranged between the key top and the carrier member and capable of shifting in the direction of the rotation axis, wherein the first and second push switch parts are arranged above and underneath the driver, one above and the other underneath, with this driver in between.

A seventh means to solve the problems noted above has a configuration wherein one of the first and second push switch parts is supported over the plate, the other of the first and second push switch parts is supported over the driver, the one suppressive switching unit supported by the plate is operated by the driver, and the other suppressive switching unit supported by the driver is operated by the key top.

An eighth means to solve the problems noted above has a configuration wherein the carrier member is provided with a guide for guiding the shifting of the driver in the direction of the rotation axis.

A ninth means to solve the problems noted above has a configuration wherein the first and the suppressive switching units comprise one flexible insulating substrate provided with fixed contacts for the first and second push switch parts and movable contacts for the first and second push switch parts, to be engaged with and disengaged from the fixed contacts, the bending of the flexible insulating substrate causes it to be mounted over the plate or the driver, one of the first and second push switch parts is arranged between the key top and the driver, and the other is arranged between the driver and the plate.

A tenth means to solve the problems noted above has a configuration wherein the double-action push switch unit and the rotary electrical part are arranged on different sides of the plate of the carrier member, and the double-action push switch unit is positioned toward the key top.

An eleventh means to solve the problems noted above has a configuration wherein the rotary electrical part is provided with a rotor rotating together with the knob, a slider provided on this rotor, and a conducting pattern provided on a flexible insulating substrate, the slider coming into sliding contact with the conducting pattern, and fixed contacts for the first and second push switch parts are formed over the flexible insulating substrate.

A twelfth means to solve the problems noted above has a configuration further provided with a supporting member for supporting the carrier member, wherein the flexible insulating substrate mounted over the supporting member is held between the supporting member and the carrier member.

A thirteenth means to solve the problems noted above has a configuration wherein the rotor is arranged between the plate of the carrier member and the supporting member, side walls provided on the rotor are in contact with or close to part of the flexible insulating substrate positioned on an outer circumference of the conducting pattern to prevent the flexible insulating substrate from floating off.

A fourteenth means to solve the problems noted above has a configuration wherein the plate of the carrier member has a shaft provided in its central part and a plurality of projections protruding from the tip of the shaft in the direction of the rotation axis, the shaft is pressed through a hole bored in the rotor to rotatably support the rotor and the knob, and the projections are pressed through holes bored in the flexible insulating substrate and the supporting member to fit the carrier member to the supporting member.

A fifteenth means to solve the problems noted above has a configuration wherein the flexible insulating substrate is held between the tip of the shaft and the supporting member.

A sixteenth means to solve the problems noted above has a configuration wherein a forcing member intervenes between the carrier member and the rotor and/or the knob and, when the rotor has rotated via the knob, the rotor is returned to its initial position by the forcing member.

A seventeenth means to solve the problems noted above has a configuration wherein a stopper to limit a range of rotation of the rotor is provided between the carrier member and the rotor and/or the knob.

An eighteenth means to solve the problems noted above has a configuration wherein the rotary electrical part has a detent mechanism and, when the knob is rotated, the knob turns with articulation.

A nineteenth means to solve the problems noted above has a configuration wherein the detent mechanism is arranged within the rotor.

DETAILED DESCRIPTION OF THE PREFERRED EMBODIMENTS

Figure 1:
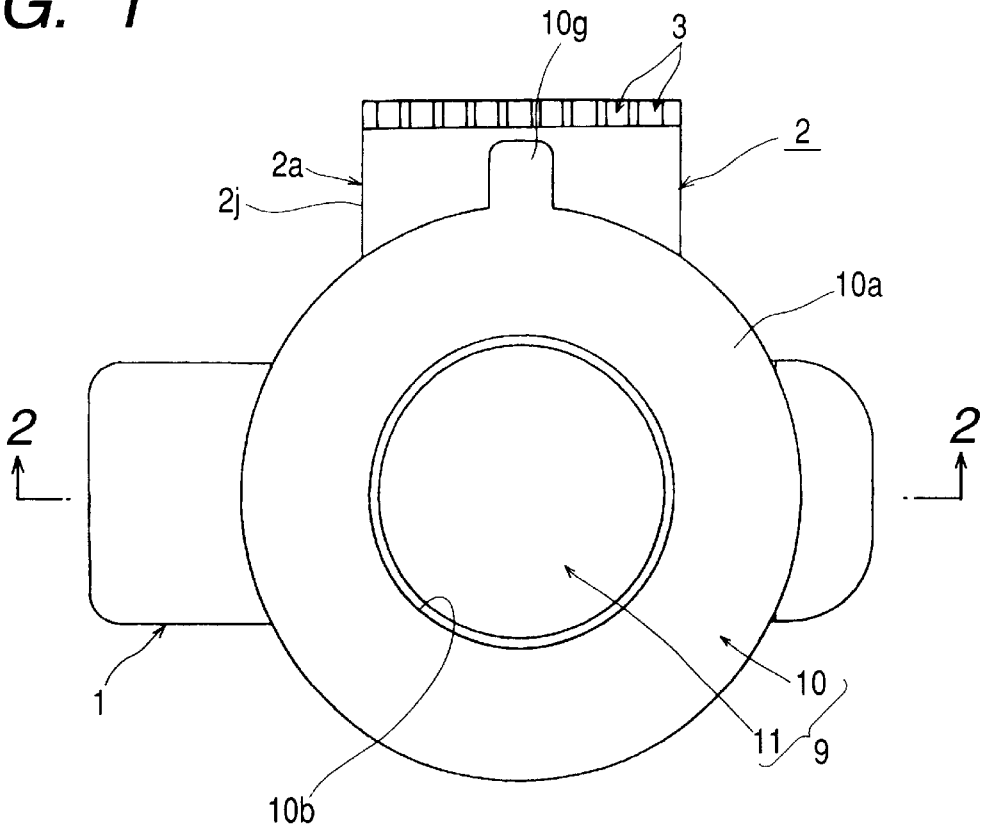
FIG. 1 is a plan of a complex operation input device, which is a first preferred embodiment of the present invention.
Figure 2:
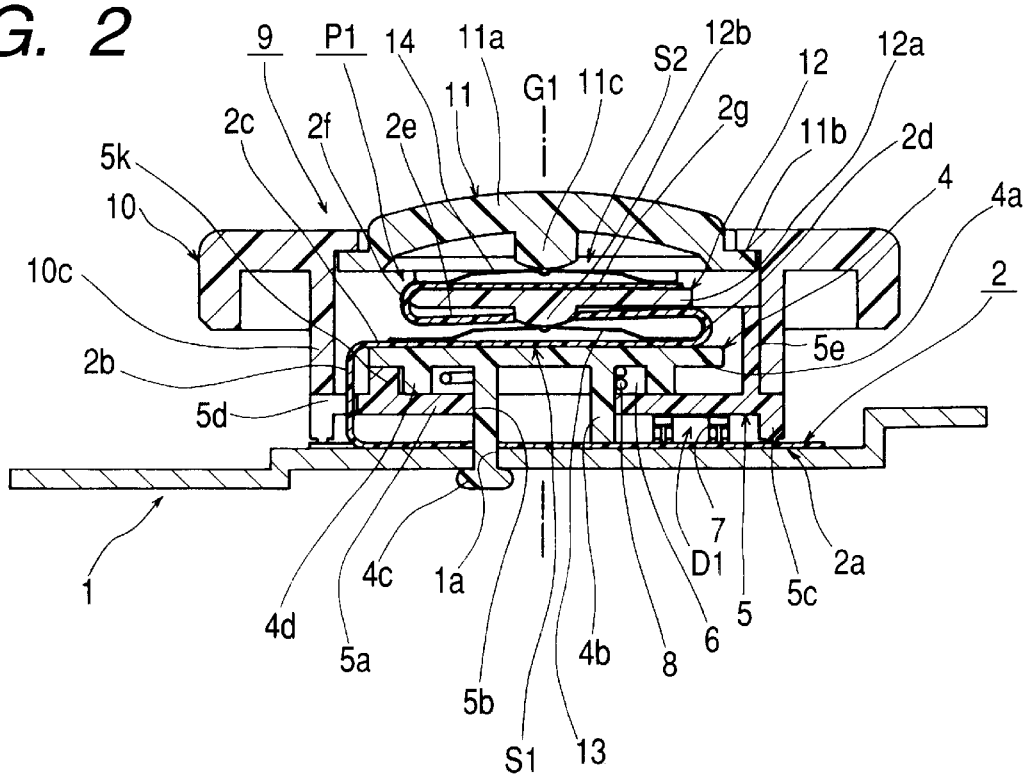
FIG. 2 is a section along line 2—2 in FIG. 1.
Figure 3:
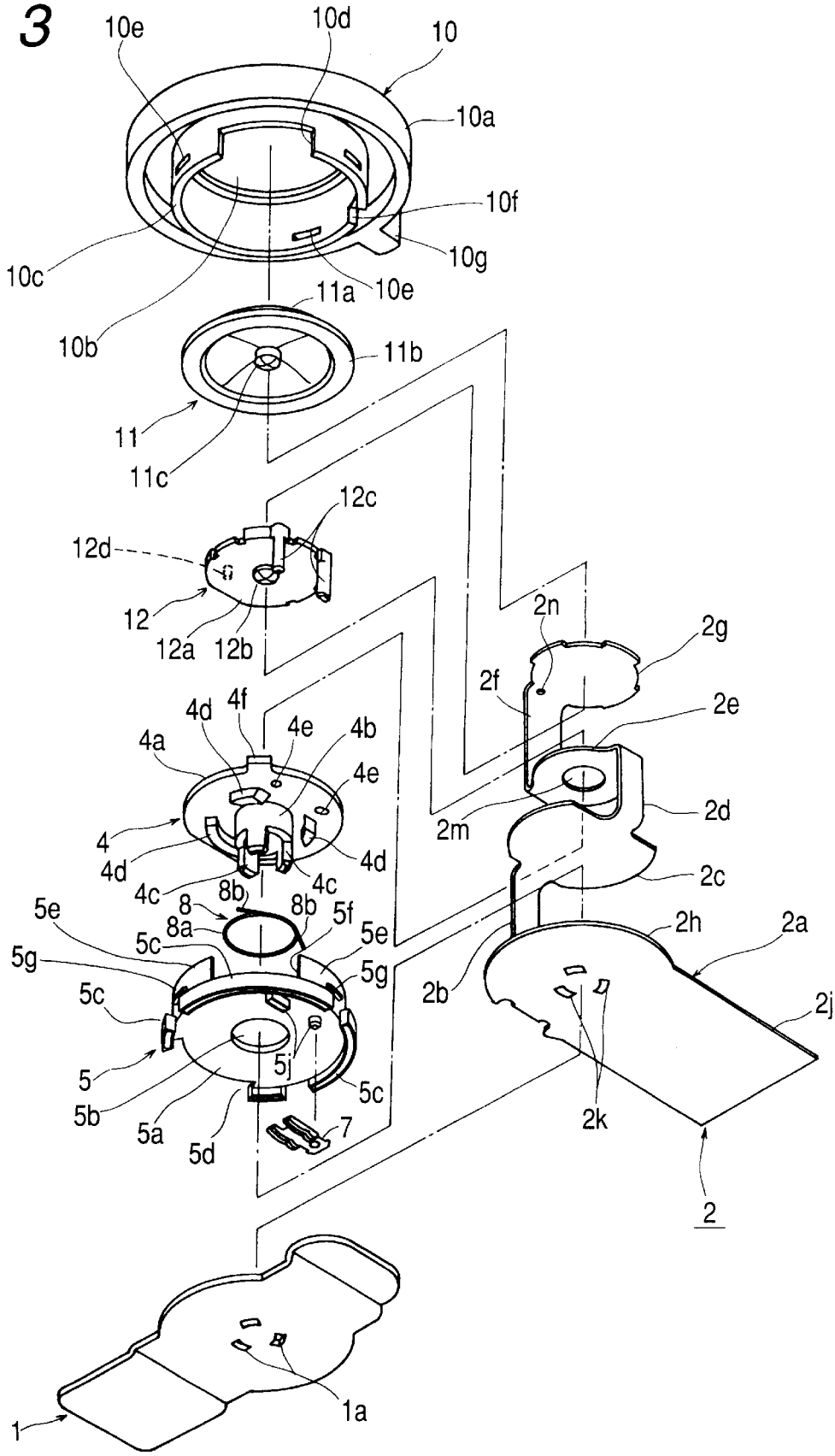
FIG. 3 shows an exploded perspective view of the complex operation input device, which is the first preferred embodiment of the invention.
Figure 4:
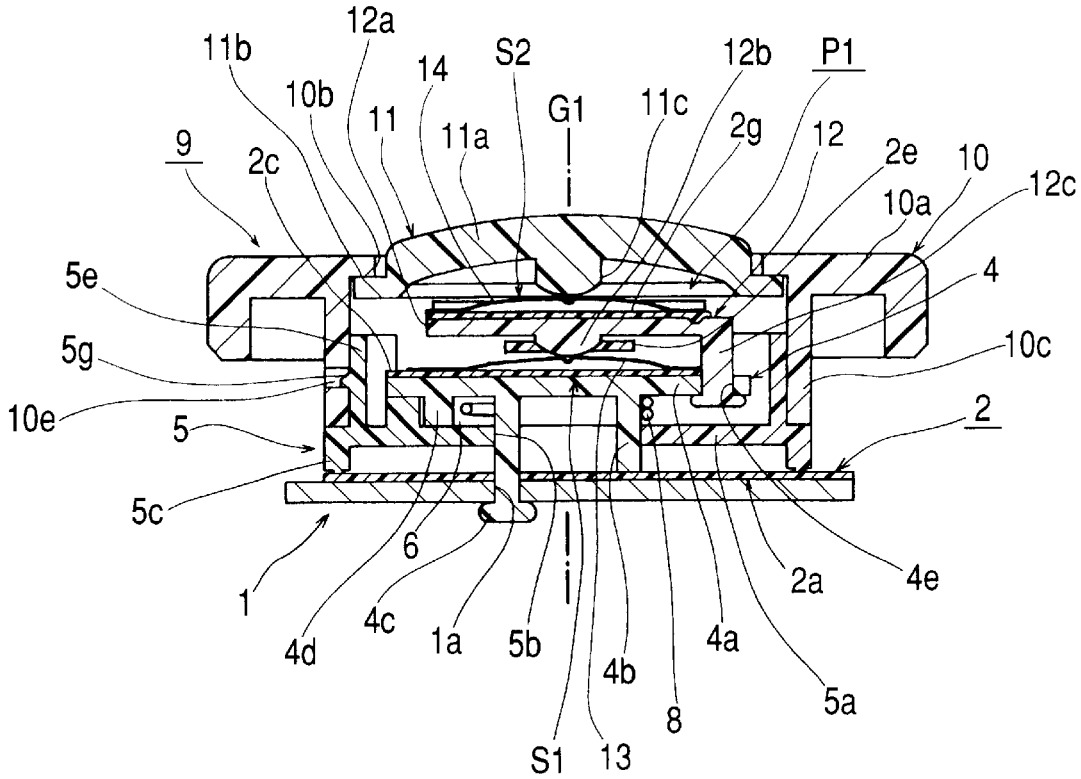
FIG. 4 illustrates how a rotor and a knob are coupled to each other and how a driver is guided in the complex operation input device, which is the first preferred embodiment of the invention.
Figure 5:
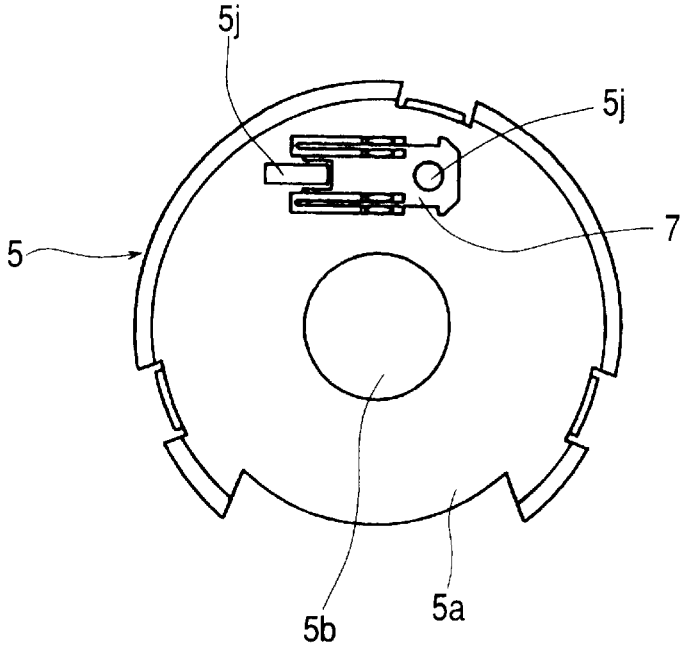
FIG. 5 shows the under side of the rotor pertaining to the complex operation input device embodying the invention in the first mode, illustrating how a slider is fitted.

To explain drawings illustrating a complex operation input device according to the present invention, FIG. 1 is a plan of a complex operation input device, which is a first preferred embodiment of the invention; FIG. 2 is a section along line 2—2 in FIG. 1; FIG. 3 shows an exploded perspective view of the complex operation input device, which is the first preferred embodiment of the invention; FIG. 4 illustrates how a rotor and a knob are coupled to each other and how a driver is guided in the complex operation input device, which is the first preferred embodiment of the invention; and FIG. 5 shows the under side of the rotor pertaining to the complex operation input device embodying the invention in the first mode, illustrating how a slider is fitted.

Figure 6:
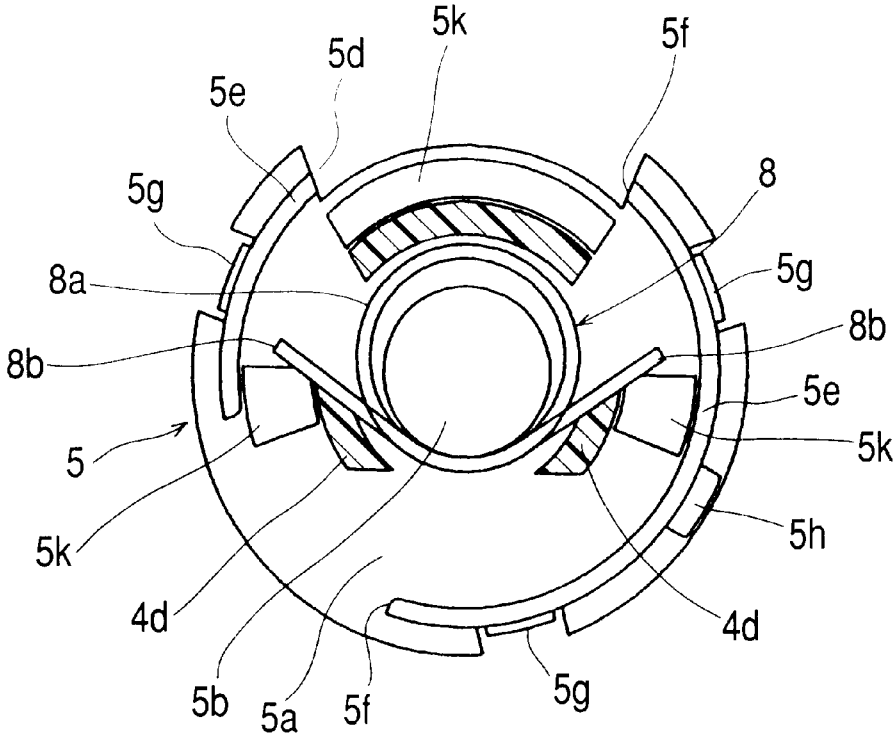
FIG. 6 shows the operation of the complex operation input device embodying the invention in the first mode, illustrating the state of its initial position.
Figure 7:
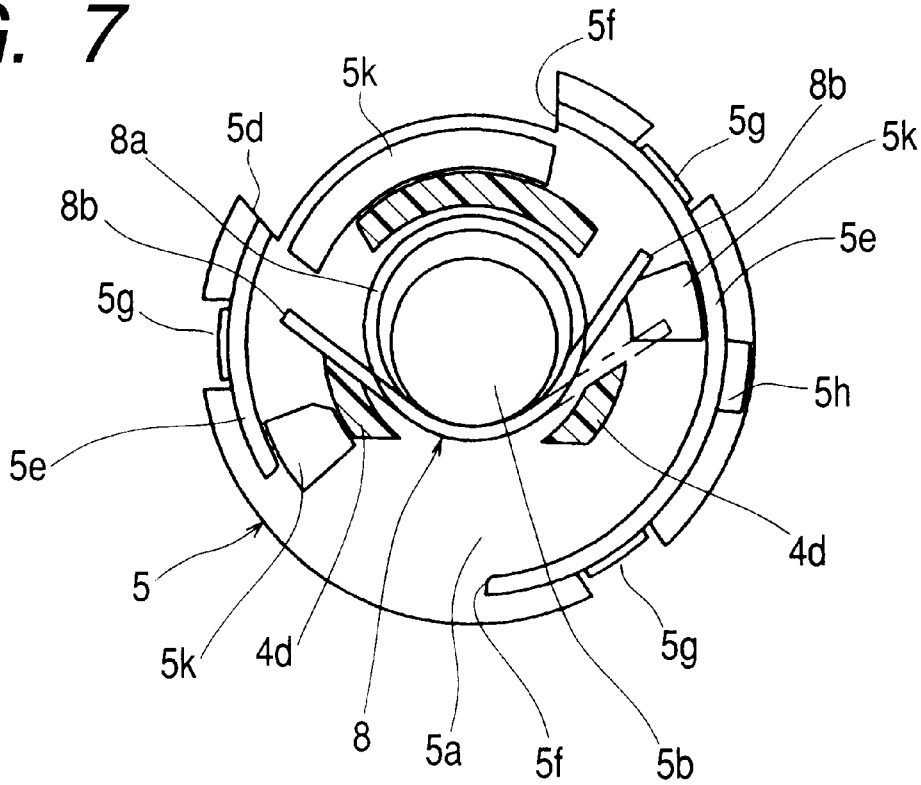
FIG. 7 shows the operation of the complex operation input device embodying the invention in the first mode, illustrating the state of its operation.
Figure 8:
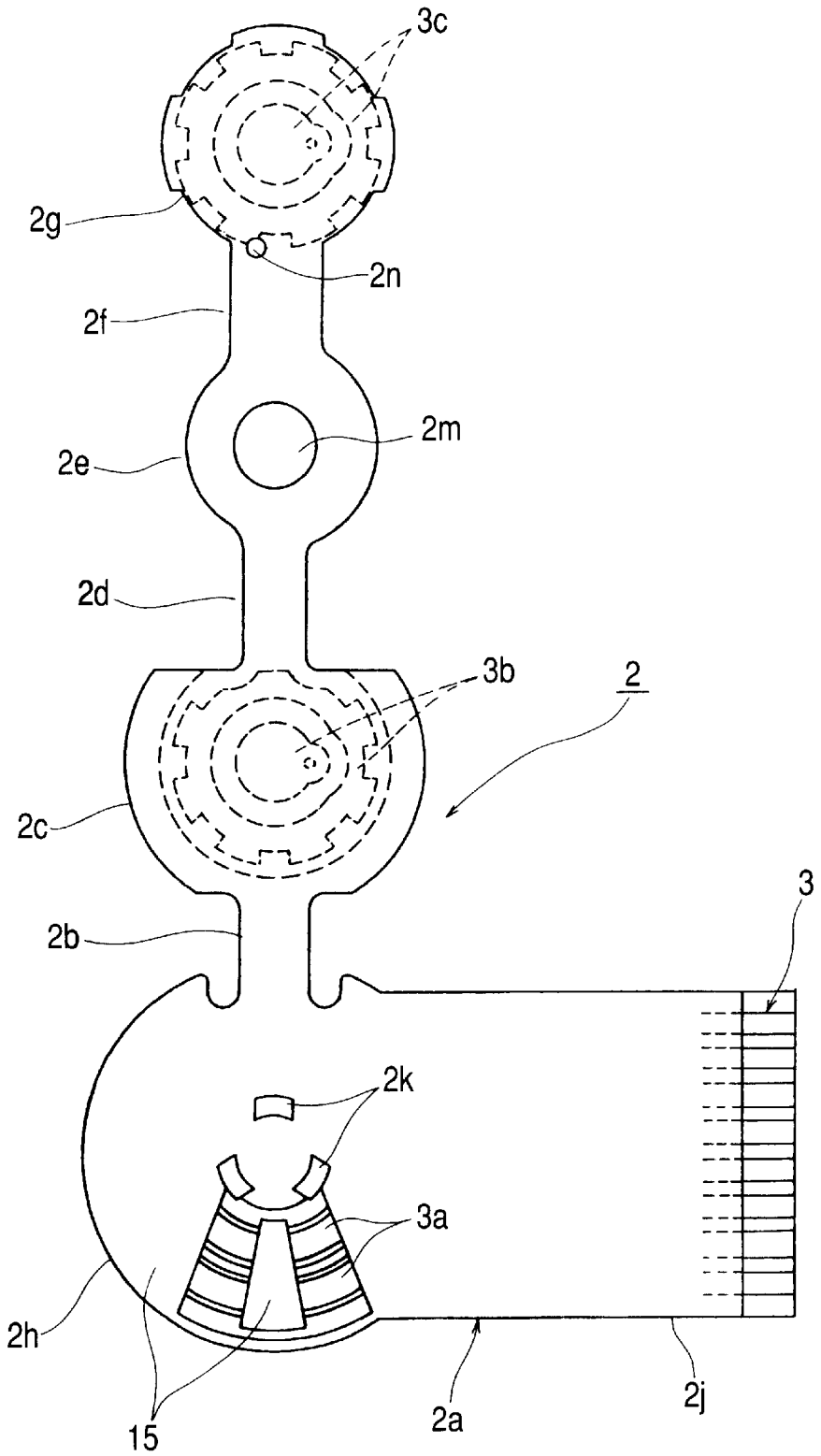
FIG. 8 shows a development of a flexible insulating substrate in the complex operation input device embodying the invention in the first mode.
Figure 9:
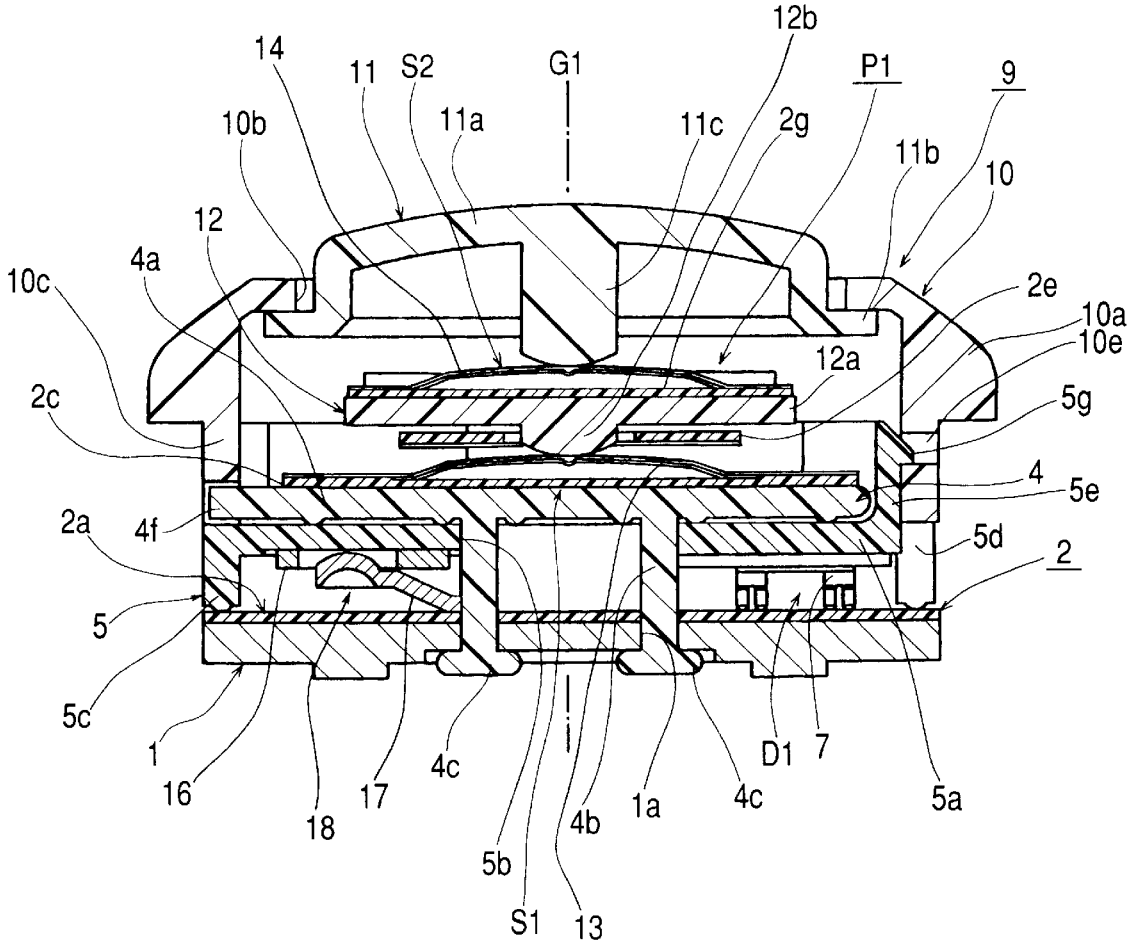
FIG. 9 shows a section of the essential part of a complex operation input device, which is a second preferred embodiment of the invention.
Figure 10:
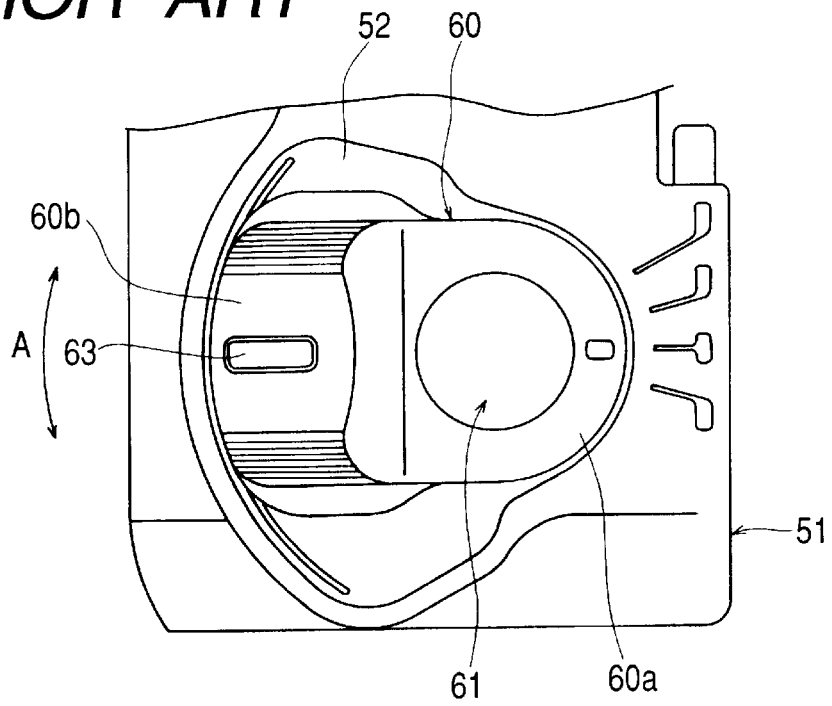
FIG. 10 PRIOR ART
FIG. 10 shows a plan of the complex operation input device according to the prior art.
Figure 11:
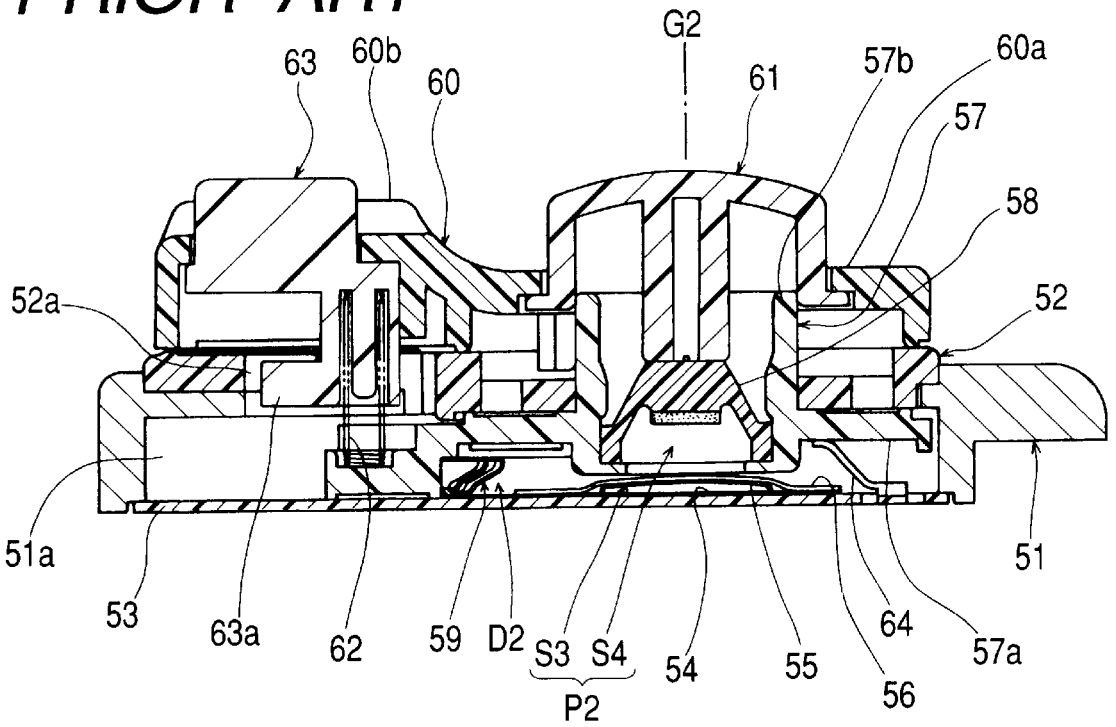
FIG. 11 PRIOR ART
FIG. 11 shows a section of the essential part of the complex operation input device according to the prior art.

Further, FIG. 6 shows the operation of the complex operation input device embodying the invention in the first mode, illustrating the state of its initial position; FIG. 7 shows the operation of the complex operation input device embodying the invention in the first mode, illustrating the state of its operation; FIG. 8 shows a development of a flexible insulating substrate in the complex operation input device embodying the invention in the first mode; and FIG. 9 shows a section of the essential part of a complex operation input device, which is a second preferred embodiment of the invention.

Next will be described the configuration of a complex operation input device, which is the first preferred embodiment of the invention with reference to FIG. 1 through FIG. 8. A supporting member 1 consisting of a metal plate, synthetic resin or the like is planarly shaped, and in its central part has a plurality of holes 1*a* provided on the same circle.

A flexible insulating substrate 2 consisting of a sheet of insulating film, as shown in FIG. 3 and FIG. 8 in particular, has a planar first base 2*a*; a first link 2*b* bent upward from this first base 2*a*; a planar second base 2*c* arranged, in a state of being linked to this first link 2*b*, opposite the first base 2*a*; a second link 2*d* bent upward from this second base 2*c* and positioned on the reverse side to the first link 2*b* with the second base 2*c* in between; a planar third base 2*e* arranged, in a state of being linked to this second link 2*d*, opposite the second base 2*c*; a third link 2*f* bent from this third base 2*e* and positioned on the reverse side to the second link 2*d* with the third base 2*e* in between; and a planar fourth base 2*g* arranged, in a state of being linked to this third link 2*f*, opposite the third base 2*e*.

The first base 2*a* of the flexible insulating substrate 2 has a wide portion 2*h* and a drawer 2*j* linked to this wide portion 2*h*. The flexible insulating substrate 2 in the central part of the wide portion 2*h* has a plurality of holes 2*k* provided on the same circle, a hole 2*m* provided in the central part of the third base 2*e*, and a small hole 2*n* provided in the vicinity of the third link 2*f* of the fourth base 2*g*.

On the surface of this flexible insulating substrate 2, as illustrated in particular in FIG. 8, is drawn a wiring pattern 3 consisting of an electric conductor. This wiring pattern 3 has, in the position of the outer circumference of the holes 2*k*, a conducting pattern 3*a* provided on the first base 2*a* to constitute a fixed contact; a pair of first fixed contacts 3*b* provided on the second base 2*c*; and a pair of second fixed contacts 3*c* provided on the fourth base 2*g*. These first and second fixed contacts 3*b* and 3*c* are led to the drawer 2*j* by the wiring pattern 3 provided on the first, second and third links 2*b*, 2*d* and 2*f* and the first, second, third and fourth bases 2*a*, 2*c*, 2*e* and 2*g*, and the conducting pattern 3*a* is also led by the wiring pattern 3 to the wide portion 2*h*.

Over the flexible insulating substrate 2 is provided an insulating film (insulating resist) 15 with the conducting pattern 3*a*, the first and second fixed contacts 3*b* and 3*c*, and the wiring pattern 3 partly exposed, and the conducting pattern 3*a* is exposed on the right and left with the insulating film 15 in the middle.

In the flexible insulating substrate 2 being configured in this way, the holes 2*k* are matched with the holes 1*a* of the supporting member 1 and, with the conducting pattern 3*a* directed upward, the first base 2*a* is mounted over the supporting member 1.

A carrier member 4, which is a molded synthetic resin item, has a flat plate 4*a*, a cylindrical shaft 4*b* protruding downward from this plate 4*a*, a plurality of projections 4*c* projecting downward from the tip of this shaft 4*b*, three stubs 4*d* provided on the under face of the plate 4*a* to surround the shaft 4*b* at intervals, a guide 4*e* consisting of two holes penetrating the plate 4*a*, and a stopper 4*f* consisting of a convex protruding in the radial direction from the outer circumference of the plate 4*a*.

This carrier member 4 presses the projections 4*c* through the holes 2*k* of the flexible insulating substrate 2 and the holes 1*a* of the supporting member 1, and the tips of the projections 4*c* are heat-caulked to fit the carrier member 4 to the supporting member 1.

In this arrangement, the first base 2*a* of the flexible insulating substrate 2 is supported by being held between the tip of the shaft 4*b* and the supporting member 1 to prevent the first base 2*a* from floating off the supporting member 1.

A rotor 5, which is a molded synthetic resin item, has a disk-shaped base 5*a*, a hole 5*b* provided in the central part of this base 5*a*, a plurality of arcwise side walls 5*c* protruding downward from the outer circumference of the base 5*a*, a plurality of cuts 5*d* provide between these side walls 5*c*, a plurality of arcwise walls 5*e* protruding upward from the outer circumference of the base 5*a*, a plurality of grooves 5*f* provided between these walls 5*e*, a plurality of projections 5*g* protruding outward from the outer faces of the walls 5*e*, an engaging piece 5*h* (see FIG. 6 and FIG. 7) consisting of one convex projecting outward from the outer face of one of the walls 5*e*, a plurality of stubs 5*j* projecting downward from the lower face of the base 5*a*, and a plurality of engaging stubs 5*k* (see FIG. 6 and FIG. 7) projecting upward at intervals on the upper face of the base 5*a*.

This rotor 5 is fitted between the plate 4*a* of the carrier member 4 and the supporting member 1 to be rotatable around the shaft 4*b*, with the shaft 4*b* of the carrier member 4 being pressed through the hole 5*b*.

When the rotor 5 is fitted, the tops of the stubs 4*d* come into contact with the upper face of the base 5*a* in a state in which the plate 4*a* is positioned within the walls 5*e*, with the result that a void 6 is formed between the plate 4*a* and the base 5*a*. At the same time, in a state in which the side walls 5*c* surround the conducting pattern 3*a*, the lower ends of the side walls 5*c* come into contact with or are positioned close to the first base 2*a* to prevent the flexible insulating substrate 2 from floating off.

Also, when the rotor 5 is fitted, the flexible insulating substrate 2 has a configuration that, in a state in which the bent first link 2*b* extends upward through the cuts 5*d* and the first fixed contact 3*b* faces upward, the second base 2*c* is mounted on the plate 4*a*.

Further, when the rotor 5 is fitted, if the stopper 4*f* of the carrier member 4 is positioned in the grooves 5*f* of the rotor 5, the rotation of the rotor 5 causes the walls 5*e* positioned in the grooves 5*f* to hit against the stopper 4*f* to limit the range of rotation of the rotor 5.

A slider 7 consisting of a springy metal plate, as shown in FIG. 5 in particular, is fitted to the rotor 5 by caulking by one of the stubs 5*j* in a state in which it is positioned on the under face of the base 5*a* of the rotor 5 so that it rotates together with the rotor 5, and at the same time another of the stubs 5*j*, positioned in the central part of the slider 7, determines the position of the slider 7.

This slider 7 slides in contact with the conducting pattern 3*a* to switch from one contact to another, and this slider 7 and the conducting pattern 3*a* constitute a rotary electrical part D1.

A forcing member 8 consisting of a twisted coil spring has a wound portion 8*a* and a pair of arms 8*b* projecting in the radial direction from the two ends of the wound portion 8*a*. This forcing member 8 is accommodated in the void 6 in a state in which the shaft 4*b* is pressed through the wound portion 8*a*. As shown in FIG. 6 in particular, it is fitted in a state in which the pair of arms 8*b* are in contact with two of the stubs 4*d* and in contact with two of the engaging stubs 5*k* of the rotor 5.

Thus, the forcing member 8 intervenes between the rotor 5 and the carrier member 4.

As in this process the engaging stubs 5*k* are in contact with the arms 8*b*, the rotor 5 is prevented from playing and is in its initial (neutral) position.

When the rotor 5 in this initial position rotates in either the clockwise or counterclockwise direction, the rotor 5, accompanied by the slider 7 as shown in FIG. 7, hooks one of the arms 8*b* and rotates against the elasticity of the arm 8*b* to cause the rotary electrical part D1 to be operated. At the same time, when the rotor 5 has rotated by a prescribed angle, the stopper 4*f* hits against the walls 5*e* to stop the rotation.

If the rotor 5 in this state is released from rotation, the rotor 5 is returned to its initial position by the elasticity of the arms 8*b* for self-returning.

An operating member 9 is configured of an annular knob 10 and a key top 11 arranged in the central part of this knob 10, and the knob 10 has an annular base 10*a*, a hole 10*b* bored in the central part of this base 10*a*, a cylinder 10*c* provided to surround this hole 10*b* and protruding downward from the under face of the base 10*a*, a wide notch 10*d* provided in the cylinder 10*c*, engaging portions 10*e* consisting of a plurality of recesses provided in the cylinder 10*c*, a narrow notch 10*f* provided in the cylinder 10*c*, and a convex 10*g* protruding in the radial direction from the outer circumference of the base 10*a*.

This knob 10, in a state in which the flexible insulating substrate 2 and the carrier member 4 are positioned within the cylinder 10*c*, fits the walls 5*e* of the rotor 5 into the cylinder 10*c*.

Then, the projections 5*g* of the rotor 5 are snapped onto the engaging portions 10*e* of the cylinder 10*c*, the engaging piece 5*h* is positioned within the notch 10*f* of the knob 10 to couple the knob 10 to the rotor 5, and at the same time the rotation of the knob 10 causes the rotor 5 to turn.

Thus, with the circular hole 5*b* bearing the shaft 4*b*, the knob 10 and the rotor 5 are enabled to turn.

And the positioning of the engaging piece 5*h* in and its engagement with the notch 10*f* of the knob 10 enables the rotary action of the knob 10 to be reliably transmitted to the rotor 5.

Although the forcing member 8 intervening between the rotor 5 and the carrier member 4 in the preferred embodiment described above, when the knob 10 is turned, enables the knob 10 to return automatically, the forcing member 8 may as well intervene between the knob 10 and the carrier member 4 to enable the knob 10 to return automatically.

The regulation of the range of rotation of the knob 10 and the rotor 5 is accomplished by the coming into contact of both ends of the cylinder 10*c* positioned on the two sides of notch 10*d* of the knob 10 with the stopper 4*f* of the carrier member 4.

The key top 11, which is a molded synthetic resin item, has a saucer-shaped button 11a consisting of a disk, a collar 11*b* provided on the outer circumference of the button 11*a*, and a suppressor 11*c* consisting of a convex projecting downward from the central part of the under face of the button 11*a*.

This key top 11 inserts the button 11*a* into the hole 10*b* of the knob 10 from underneath, and engages the collar 11*b* for the prevention of coming-off with the knob 10, so that the key top 11 is fitted to the knob 10 to be vertically movable.

A driver 12, which is a molded synthetic resin item, has a disk-shaped base 12*a*, a suppressor 12*b* projecting downward from the central part of the under face of this base 12*a*, a pair of guide rods 12*c* projecting downward from the outer circumference of the base 12*a*, and a stub 12*d* projecting upward from the periphery of the upper face of the base 12*a*.

This driver 12 is arranged between the key top 11 and the plate 4*a* of the carrier member 4, and is fitted to be vertically movable in a state in which the guide rods 12*c* are inserted into the guide 4*e* of the carrier member 4 and the base 12*a* is in parallel with the plate 4*a* of the carrier member 4.

Thus, the driver 12 is vertically movable, guided by the guide 4*e*.

When the driver 12 is incorporated, the flexible insulating substrate 2, in a state in which its second link 2*d* is bent toward the driver 12 and the suppressor 12*b* is pressed into the hole 2*m*, the third base 2*e* is positioned on the under face of the base 12*a* of the driver 12, the third link 2*f* is bent in a U shape to place the second fixed contact 3*c* upward and, in a state in which the stub 12*d* is engaged with the small hole 2*n*, the fourth base 2*g* is mounted over the base 12*a* of the driver 12.

First and second movable contacts 13 and 14 consist of dome-shaped leaf springs (click springs) differing in operating force from each other. The first movable contact 13 is arranged between the carrier member 4 and the driver 12 in a state in which it is in contact with one (the outer one) of the first fixed contacts 3*b* and is opposite the other (the inner one) of the first fixed contacts 3*b* and the suppressor 12*b*. The second movable contact 14 is arranged between the driver 12 and the key top 11 in a state in which it is in contact with one (the outer one) of the second fixed contacts 3*c* and is opposite the other (the inner one) of the second fixed contacts 3*c* and the suppressor 11*c*.

The first movable contact 13 suppresses (comes into contact with) the driver 12 to support the driver 12, and the second movable contact 14 suppresses (comes into contact with) the key top 11 to support the key top 11, thereby preventing the driver 12 and the key top 11 from playing.

The first and second movable contacts 13 and 14 are held on the flexible insulating substrate 2 by adhesive tapes.

Between the carrier member 4 and the driver 12, there is arranged a first push switch part S1 consisting of the pair of first fixed contacts 3*b* and the first movable contact 13, and between the key top 11 and the driver 12, there is arranged a second push switch part S2 consisting of the pair of second fixed contacts 3*c* and the second movable contact 14.

These first and second push switch parts S1 and S2 are arranged above and underneath the driver 12 with the driver 12 in between. The first and second push switch parts S1 and S2, being arranged in a layered state in the direction of the rotation axis G1, are supported over the plate 4*a*.

These first and second push switch parts S1 and S2 are operated in the following manner. First, when the key top 11 is suppressed, the key top 11 shifts in the direction of the rotation axis G1 to cause the suppressor 11*c* to suppress the second movable contact 14, the second movable contact 14 is thereby inverted to click, and the second movable contact 14 comes into contact with the other one (the inner one) of the second fixed contacts 3*c* to work the second push switch part S2.

Then, as the key top 11 is further suppressed following the operation described above, the driver 12 shifts in the direction of the rotation axis G1 to cause the suppressor 12*b* to suppress the first movable contact 13, the first movable contact 13 is thereby inverted to click, and the first movable contact 13 comes into contact with the other one (the inner one) of the first fixed contacts 3*b* to work the first push switch part S1.

The first and second push switch part S1 and S2 operating in two stages as described above constitute a double-action push switch unit P1.

This double-action push switch unit P1, in a state of being positioned toward the key top 11, arranged on the different side from the rotary electrical part D1 with the plate 4*a* of the carrier member 4 in between, and the double-action push switch unit P1 and the rotary electrical part D1 are arranged in a layered state in the direction of the rotation axis G1.

Incidentally, the foregoing description of this embodiment of the invention assumes that the operating force of the first movable contact 13 is greater than that of the second movable contact 14, but the latter may as well be greater than the former.

Next to describe the operation of the complex operation input device according to the invention, first, as the key top 11 is suppressed in the direction of the rotation axis G1, the second movable contact 14 is suppressed by the suppressor 11*c*, the second movable contact 14 is thereby inverted to click, and the second movable contact 14 comes into contact with the other one (the inner one) of the second fixed contacts 3*c* to work the second push switch part S2.

Then, as the key top 11 is further suppressed following the operation described above, the driver 12 shifts, while being guided by the guide 4*e*, in the direction of the rotation axis G1 to cause the suppressor 12*b* to suppress the first movable contact 13, the first movable contact 13 is thereby inverted to click, and the first movable contact 13 comes into contact with the other one (the inner one) of the first fixed contacts 3*b* to work the first push switch part S1.

Then, when the key top 11 is released from suppression, the first movable contact 13 returns to its original state by self-reversal, the driver 12 is pressed back to its original state, the second movable contact 14 also returns to its original state by self-reversal, and the key top 11 is pressed back to its original state, i.e. the state before the suppression.

Next to describe the operation of the rotary electrical part D1, in its initial position, the slider 7 is placed over the insulating film 15, and if in this state the convex 10*g* of the knob 10 is held and the knob 10 is turned from its initial position (neutral position) clockwise or counterclockwise against the forcing member 8, it is turned until the rotor 5 and the slider 7 are stopped by the stopper 4*f*, with the result that the slider 7 comes into sliding contact with the conducting pattern 3*a* to work the rotary electrical part D1.

When the knob 10 is released from rotation, the rotor 5 to which the slider 7 is fitted and the knob 10 are pushed back by the forcing member 8 for self-returning to its initial position.

In this way, the complex operation input device is operated. When used in a digital camera, for instance, such a complex operation input device enables the rotary electrical part D1 to be suitably used for zooming and the double-action push switch unit P1 to be suitably used for focusing and shutter releasing.

Although this embodiment of the invention has been described with reference to a configuration in which the operating member 9 is composed of the knob 10 and the key top 11, another configuration in which only one operating member is used and this single operating member can both rotate and shift in the axial direction is also conceivable.

The first and second push switch parts S1 and S2 may either use rubber contacts and the like or be suppressive switches of some other configuration.

Also, the forcing member 8 may consist of some other springy member than a twisted coil spring and, though this embodiment is supposed to use a rotary switch as the rotary electrical part D1, it may as well be some other electrical part such as a rotary variable resistor.

FIG. 9 shows a complex operation input device, which is a second preferred embodiment of the present invention.

This second embodiment has no forcing member 8, and also differs from the first embodiment described above in that neither the knob 10 nor the rotor 5 self-returns.

In this second embodiment, a click plate 16 consisting of a metal plate or the like having an uneven surface is fitted to the rotor 5 within the rotor 5, and a spring 17 to engage with and disengage from this click plate 16 is fitted to the supporting member 1.

Within the rotor 5, a detent mechanism 18 consisting of the click plate 16 and the spring 17 is arranged. When the knob 10 is turned clockwise or counterclockwise, the click plate 16 turns together with the rotor 5, and engages with or disengages from the spring 17 to rotate with articulation, also to work the rotary electrical part D1.

Since other aspects of the configuration are the same as the first embodiment of the invention, their description is dispensed with here, the same constituent elements being assigned respectively the same reference numerals.

As the complex operation input device according to the invention has the rotary electrical part D1 and the double-action push switch unit P1 manipulated with the operating member 9 arranged in a layered state in the direction of the rotation G1 of the rotary electrical part D1, it can be reduced in size in the lateral direction and can be particularly suitable when used with a portable digital camera or the like.

As the operating member 9 is composed of the rotatable knob 10 and the key top 11 shiftable in the direction of the rotation axis G1 so that the rotation of the knob 10 cause the rotary electrical part D1 to be manipulated and the shifting of the key top 11 cause the double-action push switch unit P1 to be manipulated, the two elements can be manipulated separately, resulting in a complex operation input device capable of reliable operation.

As the key top 11 is positioned in the central part and the annular knob 10 surrounds the outer circumference of the key top 11, the key top 11 is unlikely to be suppressed inadvertently, resulting in a complex operation input device capable of reliable operation.

Furthermore, as the double-action push switch unit P1 consists of two, first and second, push switch parts S1 and S2 differing from each other in operating force and is supported by the carrier member 4, with the first and second push switch parts S1 and S2 being arranged in a layered state in the direction of the rotation G1 over the plate 4*a* provided for this carrier member 4, the first and second push switch parts S1 and S2 can accomplish stable suppression and can be reduced in size.

Since the first and second push switch parts S1 and S2 are to click by different operating forces, different actions of the double-action push switch unit P1 can be readily distinguished from each other.

Also, the first and second push switch parts S1 and S2 consist of the movable contacts 13 and 14 the fixed contacts 3*b* and 3*c*, respectively, and the movable contacts 13 and 14 are to click, the configuration can be simple and inexpensive.

There also is provided the driver 12 arranged between the key top 11 and the carrier member 4 to be shiftable in the direction of the rotation axis G1, and the first and second push switch parts S1 and S2 are arranged above and underneath this driver 12, one above and the other underneath, with the driver 12 in between. As a result, the first and second push switch parts S1 and S2 are separated from each other by the driver 12, and can operate (turning on the contact) more reliably than similar units according to the prior art, which are stacked one over the other.

Of the first and second push switch parts S1 and S2, one is supported over the plate 4*a*, the other is supported over the driver 12, the suppressive switching unit supported over the plate 4*a* is operated by the driver 12, and the other supported over the driver 12 is operated by the key top 11, resulting in more reliable actions of the first and second push switch parts S1 and S2.

As the carrier member 4 (the plate 4*a*) is provided with the guide 4*e* for guiding the shift of the driver 12 in the direction of the rotation axis G1, the shift of the driver 12 in the direction of the rotation axis G1 is made more reliable, resulting in more dependable actions of the first and second push switch parts S1 and S2.

The first and second push switch parts S1 and S2 are composed of the single flexible insulating substrate 2 provided with the fixed contacts 3*b* and 3*c* for the first and second push switch parts S1 and S2 and the movable contacts 13 and 14 for the first and second push switch parts S1 and S2, coming into and going out of contact with the fixed contacts 3*b* and 3*c*. As the bending of the flexible insulating substrate 2 causes it to be mounted the plate 4*a* or the driver 12, and the first and second push switch parts S1 and S2 are arranged between the key top 11 and the driver 12 and between the driver 12 and the plate 4*a*, respectively, it is required only to dispose the single flexible insulating substrate 2, resulting in higher productivity and a less expensive product than according to the prior art.

Also, the double-action push switch unit P1 and the rotary electrical part D1 are arranged on the different sides of the plate 4*a* of the carrier member 4 and the double-action push switch unit P1 is positioned toward the key top 11, resulting in a simple configuration and greater productivity.

The rotary electrical part D1 is provided with the rotor 5 rotating together with the knob 10, the slider 7 provided on this rotor 5, and the conducting pattern 3*a* provided on the flexible insulating substrate 2 and being in sliding contact with the slider 7, and on the flexible insulating substrate 2 are provided the fixed contacts 3*b* and 3*c* for the first and second push switch parts S1 and S2, with the result that the single flexible insulating substrate 2 can suffice, providing greater productivity and a less expensive product than does the prior art.

Further the supporting member 1 is provided to support the carrier member 4, and the flexible insulating substrate 2 mounted on the supporting member 1 is held between this supporting member 1 and the carrier member 4, making it possible to prevent the flexible insulating substrate 2 from floating off and making the actions of the rotary electrical part D1 more reliable.

Also, the rotor 5 is arranged between the plate 4*a* of the carrier member 4 and the supporting member 1, and the side walls 5*c* provided on the rotor 5 come into contact with or are positioned close to part of the flexible insulating substrate 2 positioned on the outer circumference of the conducting pattern 3*a* to prevent the flexible insulating substrate 2 from floating off, resulting in further enhanced reliability of the actions of the rotary electrical part D1.

Further, the plate 4*a* of the carrier member 4 has the shaft 4*b* provided in its central part and the plurality of projections 4*c* protruding from the end of this shaft 4*b* in the direction of the rotation axis G1; the shaft 4*b* is pressed through the hole 5*b* bored in the rotor 5 to support the rotor 5 and the knob 10 rotatably; the projections 4*c* are pressed through the holes 2*k* and 1*a* bored in the flexible insulating substrate 2 and the supporting member 1, respectively; and the carrier member 4 is fitted to the supporting member 1 by the projections 4*c*, with the result that the fitting of the carrier member 4 is simplified and the flexible insulating substrate 2 can be supported at the same time as the fitting of the carrier member 4.

As the flexible insulating substrate 2 is held between the end of the shaft 4*b* and the supporting member 1, the flexible insulating substrate 2 can be supported at the same time as the fitting of the carrier member 4, resulting in enhanced productivity.

The forcing member 8 intervenes between the carrier member 4 and the rotor 5 and/or the knob 10, so that when the rotor 5 has rotated via the knob 10, the rotor 5 is returned to its initial position by the forcing member 8, with the result that the knob 10 can self-return and manipulating ease is ensured.

Furthermore, as the forcing member 8 is configured of a twisted coil spring, it can be fitted in a state of being held by the shaft 4*b*, resulting in reliable fitting of the forcing member 8.

Also, as the stopper to limit the range of rotation of the rotor 5 is provided between the carrier member 4 and the rotor 5, the knob 10 is prevented from rotating more than necessary, and the reliability of operation is thereby ensured.

Moreover, as the rotary electrical part D1 has the detent mechanism 18 and, when the knob 10 is rotated, the knob 10 is caused to rotate with articulation, the degree of rotation of the knob 10 can be readily perceived to ensure manipulating ease.

Further, as the detent mechanism 18 is arranged within the rotor 5, the whole device can be built compact.

What is claimed is:

1. A complex operation input device provided with an operating member, a rotary electrical part manipulated with the operating member a double-action push switch unit manipulated with the operating member, and a driver arranged between the key top and the carrier member and capable of shifting in the direction of the rotation axis, wherein the rotary electrical part and the double-action push switch unit are arranged in a layered state in a direction of a rotation axis of the rotary electrical part, wherein the operating member comprises a rotatable knob and a key top shiftable in the direction of the rotation axis, wherein the rotary electrical part is operated by rotation of the knob and wherein the double-action push switch unit is operated by the shifting of the key top, wherein the double-action push switch unit comprises two, first and second, push switch parts differing from each other in operating force, wherein a carrier member is provided to support the double-action push switch unit, wherein the carrier member has a plate, and wherein over the plate the first and second push switch parts are arranged in a layered state in the direction of the rotation axis, and wherein the first and second push switch parts are arranged above and underneath the driver, one above and the other underneath, with the driver in between.

2. The complex operation input device according to claim 1, wherein the knob is annularly shaped and arranged so as to surround an outer circumference of the key top.

3. The complex operation input device according to claim 1, wherein the first and second push switch parts click by operating forces differing from each other.

4. The complex operation input device according to claim 1, wherein one of the first and second push switch parts is supported over the plate, wherein the other of the first and second push switch parts is supported over the driver, wherein the one suppressive switching unit supported by the plate is operated by the driver, and wherein the other suppressive switching unit supported by the driver is operated by the key top.

5. The complex operation input device according to claim 4, wherein the carrier member is provided with a guide for guiding shifting of the driver in the direction of the rotation axis.

6. The complex operation input device according to claim 4, wherein the first and the suppressive switching units comprise one flexible insulating substrate provided with fixed contacts for the first and second push switch parts and movable contacts for the first and second push switch parts, to be engaged with and disengaged from the fixed contacts, wherein bending of the flexible insulating substrate causes it to be mounted over the plate or the driver, wherein one of the first and second push switch parts is arranged between the key top and the driver, and wherein the other is arranged between the driver and the plate.

7. The complex operation input device according to claim 1, wherein the double-action push switch unit and the rotary electrical part are arranged on different sides of the plate of the carrier member, and wherein the double-action push switch unit is positioned toward the key top.

8. The complex operation input device according to claim 7, wherein the rotary electrical part is provided with a rotor rotating together with the knob, a slider provided on the rotor, and a conducting pattern provided on a flexible insulating substrate, the slider coming into sliding contact with the conducting pattern, and wherein fixed contacts for the first and second push switch parts are formed over the flexible insulating substrate.

9. The complex operation input device according to claim 8, further provided with a supporting member for supporting the carrier member, wherein the flexible insulating substrate mounted over the supporting member is held between the supporting member and the carrier member.

10. The complex operation input device according to claim 9, wherein the rotor is arranged between the plate of the carrier member and the supporting member, wherein side walls provided on the rotor are in contact with or close to part of the flexible insulating substrate positioned on an outer circumference of the conducting pattern to prevent the flexible insulating substrate from floating off.

11. The complex operation input device according to claim 9, wherein the plate of the carrier member has a shaft provided in its central part and a plurality of projections protruding from the tip of the shaft in the direction of the rotation axis, wherein the shaft is pressed through a hole bored in the rotor to rotatably support the rotor and the knob, and wherein the projections are pressed through holes bored in the flexible insulating substrate and the supporting member to fit the carrier member to the supporting member.

12. The complex operation input device according to claim 11, wherein the flexible insulating substrate is held between the tip of the shaft and the supporting member.

13. The complex operation input device according to claim 8, wherein a forcing member intervenes between the carrier member and the rotor and/or the knob and wherein, when the rotor has rotated via the knob, the rotor is returned to its initial position by the forcing member.

14. The complex operation input device according to claim 8, wherein a stopper to limit a range of rotation of the rotor is provided between the carrier member and the rotor and/or the knob.

15. The complex operation input device according to claim 8, wherein the rotary electrical part has a detent mechanism and wherein, when the knob is rotated, the knob turns with articulation.

16. The complex operation input device according to claim 15, wherein the detent mechanism is arranged within the rotor.

* * * * *